US007531213B2

(12) United States Patent
Björmander

(10) Patent No.: US 7,531,213 B2
(45) **Date of Patent: *May 12, 2009**

(54) METHOD FOR MAKING COATED CUTTING TOOL INSERT

(75) Inventor: Carl Björmander, Spågna (SE)

(73) Assignee: Sandvik Intellectual Property AB, Sandviken (SE)

( * ) Notice: Subject to any disclaimer, the term of this patent is extended or adjusted under 35 U.S.C. 154(b) by 243 days.

This patent is subject to a terminal disclaimer.

(21) Appl. No.: 11/403,206

(22) Filed: Apr. 13, 2006

(65) Prior Publication Data

US 2006/0257690 A1 Nov. 16, 2006

(30) Foreign Application Priority Data

Apr. 18, 2005 (SE) ..... 0500858

(51) Int. Cl.
*C23C 16/40* (2006.01)
*C23C 16/32* (2006.01)

(52) U.S. Cl. ..... 427/255.31; 427/255.32; 427/255.34; 427/255.36; 427/255.7; 427/348; 427/355

(58) Field of Classification Search ..... 427/255.31, 427/255.32, 255.34, 255.391, 255.7, 348, 427/355, 255.36
See application file for complete search history.

(56) References Cited

U.S. PATENT DOCUMENTS

| | | | | |
|---|---|---|---|---|
| 4,150,195 | A * | 4/1979 | Tobioka et al. | 428/548 |
| 4,714,660 | A * | 12/1987 | Gates, Jr. | 428/698 |
| 5,654,035 | A * | 8/1997 | Ljungberg et al. | 427/255.34 |
| 5,770,261 | A * | 6/1998 | Nakamura et al. | 427/255.19 |
| 5,800,868 | A * | 9/1998 | Lenander et al. | 427/249.19 |
| 5,861,210 | A * | 1/1999 | Lenander et al. | 428/336 |
| 6,426,137 | B1 | 7/2002 | Oshika et al. | |
| 7,153,562 | B2 * | 12/2006 | Rodmar et al. | 428/216 |
| 7,276,301 | B2 * | 10/2007 | Tsushima et al. | 428/699 |
| 2004/0224160 | A1 | 11/2004 | Ueda et al. | |
| 2005/0260432 | A1 * | 11/2005 | Sottke et al. | 428/627 |
| 2007/0298232 | A1 * | 12/2007 | McNerny et al. | 428/216 |

FOREIGN PATENT DOCUMENTS

| | | | |
|---|---|---|---|
| EP | 0 693 574 | B2 | 4/2001 |
| EP | 0 878 563 | B1 | 10/2001 |
| EP | 1 455 003 | A2 | 9/2004 |
| EP | 1705263 | A1 * | 9/2006 |
| EP | 1717348 | A2 * | 11/2006 |
| JP | 11-152570 | | 6/1998 |

OTHER PUBLICATIONS

Sahin, Y., "The effects of various multilayer ceramic coatings on the wear of carbide cutting tools when machining metal matrix composites". Surface and Coatings Technology, vol. 199, Issue 1, Sep. 1, 2005, pp. 112-117.*

* cited by examiner

*Primary Examiner*—Bret Chen
(74) *Attorney, Agent, or Firm*—Drinker Biddle & Reath LLP

(57) ABSTRACT

A method for making a coated cutting tool insert by depositing by CVD, onto a cemented carbide, titanium based or ceramic substrate a hard layer system, having a total thickness of from about 2 to about 50 μm, comprising at least one layer selected from titanium carbide, titanium nitride, titanium carbonitride, titanium carboxide and aluminum oxide, and an outer, from about 1 to about 15 μm thick, aluminum oxide layer or $(Al_2O_3+ZrO_2)$*N multilayer, a penultimate outermost layer of $TiO_x$, where x ranges from about 1 to about 2, and an outermost, from about 0.3 to about 2 μm thick, $TiC_xN_yO_z$ layer, where x+y+z=1, x≧0, y≧0, and z≧0, followed by a post-treatment removing at least said outermost layer on the edge-line and on the rake face.

8 Claims, 3 Drawing Sheets

METHOD FOR MAKING COATED CUTTING TOOL INSERT

BACKGROUND

The present invention relates to a coated cutting tool, suitable for chip forming machining of metals, and a method for producing the same. According to the present invention, there is provided a reliable method for removing coating layers on selected faces of a cutting insert during coating post-treatment.

Modem high productivity chip forming machining of metals requires reliable tools with excellent wear properties. This is achieved by employing a cemented carbide tool body coated with a wear resistant coating, of single layer or multilayer type, most commonly comprising wear layers of TiC, TiN, TiCN and $Al_2O_3$. For depositing the different layers onto the cemented carbide body, CVD, PVD, or similar coating techniques are used.

EP-A-693574 describes how different parts of a tool are subject to different types of wear during a machining operation. Since the various coating layers have different abilities to withstand the different types of wear, it is suggested to have an outermost $Al_2O_3$layer on the rake face, because of its ability to withstand diffusion type wear, and on the clearance side it is suggested to have an outermost $MeC_xN_yO_z$ type layer, where Me is a metal selected from groups IVB, VB, VIB of the periodic table, because of its high resistance to flank wear. A top layer of $TiC_xN_yO_z$ or, in particular, a goldish TiN, ZrN or HfN top layer also makes it easy to differentiate between a used and an unused cutting edge by the naked eye. Hence, the $TiC_xN_yO_z$ layer is mechanically removed from either only the edge line or from both the rake face and the edge line to expose the $Al_2O_3$layer. Normally this is done by a post-treatment such as blasting or brushing of the coated inserts.

During the post-treatment, it is important not to reduce the $Al_2O_3$ layer thickness along the edge line. The method must therefore be so gentle that only the top $TiC_xN_yO_z$ layer is removed, leaving the $Al_2O_3$at the edge line as untouched as possible. However, the described post-treatment method is unreliable as residues of $TiC_xN_yO_z$ occasionally appear on the $Al_2O_3$surface after blasting process. $TiC_xN_yO_z$ residues on the $Al_2O_3$surface reduce the flaking resistance, due to welding of $TiC_xN_yO_z$ to the work piece at the cutting edge resulting in coating withdrawal and a lower lifetime of the insert. A second effect of these residues after blasting is the discoloration, visible to the naked eye, of the $Al_2O_3$surface. In production, blasting is usually repeated or modified in order to remove residual $TiC_xN_yO_z$, but this often results in damage, such as flaking of the coating at the cutting edge line. It is therefore important to find a solution to this problem, especially for thin $Al_2O_3$ coatings, where usually lower blasting pressures are used in order not to damage the coating at the cutting edge, thus being subject to a higher risk of having $TiC_xN_yO_z$ residues after the blasting process.

In U.S. Pat. No. 6,426,137, a titanium oxide layer is utilized in order to reduce smearing onto the cutting edge. In this case the titanium oxide layer is fully covering the $Al_2O_3$ surface, acting as the top layer with a thickness of 0.1-3 μm. In another embodiment the titanium oxide layer is coated with a TiN layer.

OBJECTS AND SUMMARY OF THE INTENTION

It is an object of the present invention to solve the problem of residual $TiC_xN_yO_z$ on the post-treated edge line and rake face.

In accordance with the invention there is provided a method for making a coated cutting tool insert having an upper face (rake face), an opposite face and at least one clearance face intersecting said upper and opposite faces to define cutting edges comprising depositing by CVD, onto a cemented carbide, titanium based or ceramic substrate

- a hard layer system, having a total thickness of about from about 2 to about 50 μm, comprising at least one layer selected from titanium carbide, titanium nitride, titanium carbonitride, titanium carboxide and aluminum oxide, and an outer, from about 1 to about 15 μm thick, aluminum oxide layer or $(Al_2O_3+ZrO_2)$*N multilayer,
- a penultimate outermost layer of $TiO_x$, where x ranges from about 1 to about 2 and
- an outermost, from about 0.3 to about 2 μm thick, $TiC_xN_yO_z$ layer, where $x+y+z=1$, $x \geqq 0$, $y \geqq 0$, and $z \geqq 0$, by a post-treatment removing at least said outermost layer on the edge-line and on the rake face.

BRIEF DESCRIPTION OF THE FIGURES

*Figs.* 1A-1C are light microscope micrographs showing in 200×, the outermost $Al_2O_3$ layer of inserts according to the present invention, with various amounts of titanium nitride residues after the blasting process, in which in FIG. 1A A—TiN residues, and B—$Al_2O_3$.

DETAILED DESCRIPTION OF THE PREFERRED EMBODIMENTS OF THE INVENTION

Figure 1A:
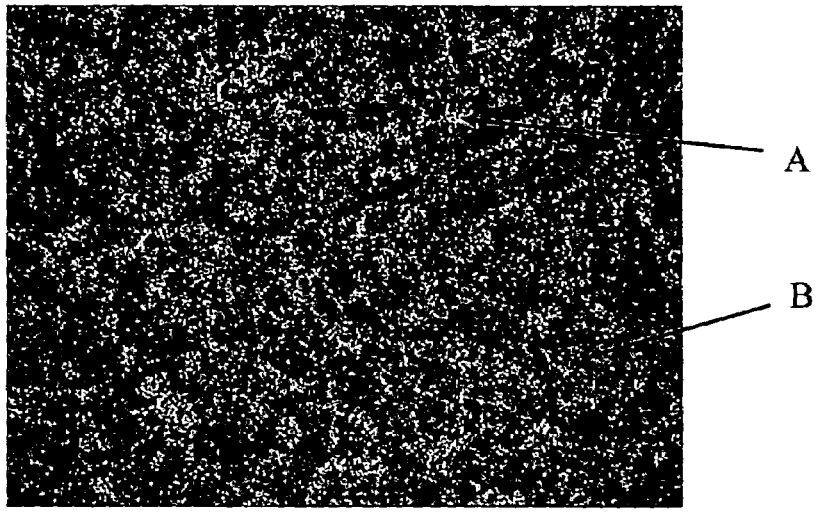

According to the present invention, there is now provided a method of making a coated cutting tool insert, having an upper face (rake face), an opposite face and at least one clearance face intersecting said upper and opposite faces to define cutting edges, comprising depositing onto a cemented carbide, titanium based or ceramic substrate, using known CVD methods

- a hard layer system, having a total thickness of from about 2 to about 50 μm, comprising least one layer selected from titanium carbide, titanium nitride, titanium carbonitride, titanium carboxide and aluminum oxide, and an outer, from about 1 to about 15 μm thick, aluminum oxide layer or $(Al_2O_3+ZrO_2)$*N multilayer,
- a penultimate outermost layer of $TiO_x$, where x ranges from about 1 to about 2, preferably from about 1.3 to about 1.9, having a thickness preferably from about 0.05 to about 3 μm, most preferably from about 0.1 to about 1.0 μm, and an outermost, from about 0.3 to about 2 μm thick, $TiC_xN_yO_z$ layer, where x+y+z=1, x≧0, y≧0, and z≧0, preferably a single layer or multilayer of TiN, TiC or $TiC_xN_y$, where x+y=1, x≧0 and y≧0, followed by a post-treatment, preferably blasting or brushing, removing at least said outermost layer on the edge-line and on the rake face. To ensure the performance of the insert and the absence of any discoloration due to TiN residues, it is preferred that said post-treatment also removes at least 50% of the $TiO_x$ layer, in terms of surface coverage, i.e., preferably at least 50% of the outer layer surface of said hard layer system is exposed.

Using $TiO_x$, which has a hardness of about 20% of that of $Al_2O_3$ with the proposed thickness, the $TiC_xN_yO_z$ layer is thus lifted up above the rough $Al_2O_3$ surface, so that it can be fully removed by the blasting media. $TiO_x$ is furthermore a transparent oxide, which means that any residues left on the $Al_2O_3$surface are not visible to the naked eye, as is the case with, e.g., TiN.

The present invention also relates to a coated cutting tool insert having an upper face (rake face), an opposite face and at least one clearance face intersecting said upper and opposite faces to define cutting edges made of cemented carbide, titanium based carbonitride or ceramics. The insert is coated with a hard layer system, having a total thickness of from about 2 to about 50 μm, comprising at least one layer selected from titanium carbide, titanium nitride, titanium carbonitride, titanium carboxide and aluminum oxide, and an outer, from about 1 to about 15 μm thick, aluminum oxide, preferably fine grained of a grain size of from about 0.50 to about 3 μm, $\alpha$-$Al_2O_3$, layer or $(Al_2O_3+ZrO_2)$*N multilayer, said hard layer system is provided with a $TiO_x$ layer, where x ranges from about 1 to about 2, preferably from about 1.3 to about 1.9, with a thickness of preferably from about 0.05 to about 3 μm, most preferably 0.1-1.0 μm, said $TiO_x$ layer being the outermost layer on the cutting edge line and rake face, and said $TiO_x$ layer is on the clearance side provided with an outermost, 0.3-2 μm thick, $TiC_xN_yO_z$ layer, where x+y+z=1, x≧0, y'preferably a single layer or multilayer of TiN, TiC or $TiC_xN_y$, where x+y=1, x≧0 and y≧0.

The grain size of the $Al_2O_3$ layer is determined from a SEM top view micrograph at 5,000 X magnification of the as deposited $Al_2O_3$ layer surface. Drawing three straight lines in random directions, the average distances between grain boundaries along the lines, are taken as a measure of the grain size.

In a preferred embodiment said $TiO_x$ layer on the edge-line and rake face covers less than 50% of the surface of said hard layer system.

The invention is additionally illustrated in connection with the following examples, which are to be considered as illustrative of the present invention. It should be understood, however, that the invention is not limited to the specific details of the examples.

EXAMPLE 1

A (invention): Cemented carbide cutting inserts CNMG 120408-PM with the composition 5.5 wt-% Co, 8.6 wt-% cubic carbides (TiC+TaC+NbC) and balance WC were coated with CVD-technique according to the following sequence: 0.7 μm TiN, 4.0 μm Ti(CN), 5.0 μm $\alpha$-$Al_2O_3$, 0.7 μm titanium oxide ($Ti_2O_3$) and 0.7 μm TiN.

The $Ti_2O_3$ layer was deposited by CVD technique, where the substrates to be coated were held at a temperature of 1010° C. and were brought in contact with a hydrogen carrier gas containing $TiCl_4$, $CO_2$ and HCl. The nucleation was started up in a sequence where the reactant gases HCl and $CO_2$ entered the reactor first, in an $H_2$ atmosphere, followed by the $TiCl_4$. The titanium oxide layer was deposited with a CVD process with the following process parameters:

| Gasflows (in %). T = 1010° C., P = 55 mbar. | $Ti_2O_3$ |
|---|---|
| $H_2$ (%) | 88.0 |
| HCl (%) | 7.6 |
| $CO_2$ (%) | 2.1 |
| $TiCl_4$ (%) | 2.3 |
| Deposition Rate (μm/hrs) | 1.5 |

The other layers where deposited by known CVD methods.

The coated inserts were post-treated by blasting at the different blasting pressures 1.8, 2.0 and 2.2 bar, using $Al_2O_3$ grits.

B (prior art): Cemented carbide cutting inserts CNMG 120408-PM with the composition 5.5 wt-% Co, 8.6 wt-% cubic carbides (TiC+TaC+NbC) and balance WC were coated with CVD-technique according to the following sequence: 0.7 μm TiN, 4.0 μm Ti(CN), 5.0 μm $\alpha$-$Al_2O_3$ and 0.7 μm TiN by known CVD methods.

The coated inserts were post treated by blasting at 2.4 bar by using $Al_2O_3$ grits.

Inserts of type A and B were studied in a light microscope (200×) to detect any TiN residues on the $Al_2O_3$ surface and further in a scanning electron microscope (500×) to detect residues of $Ti_2O_3$. The amount of residual $Ti_2O_3$ was determined using image analysis (Leica Quantimet 500). The results are summarized in the following table.

Figure 1B:
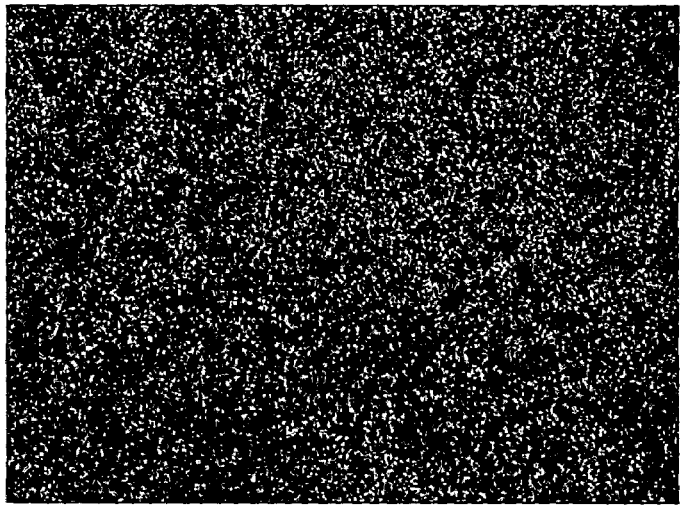
Figure 1C:
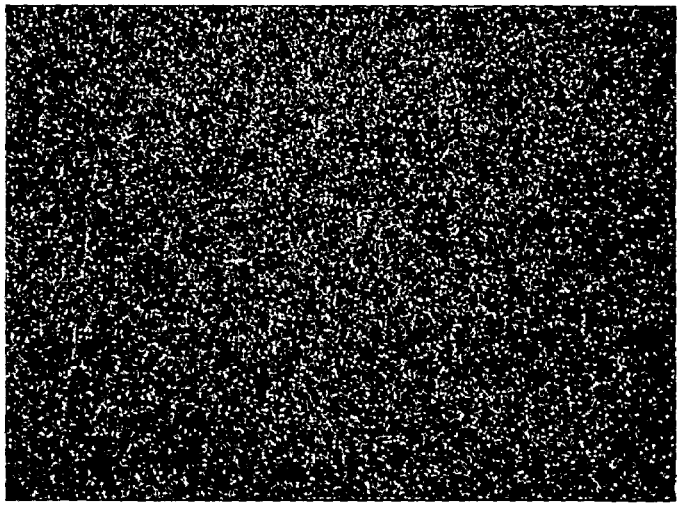
Figure 2A:
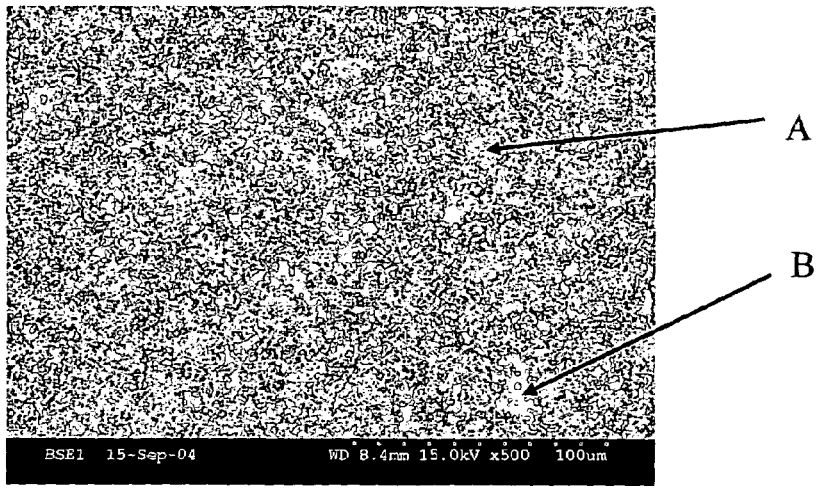
FIGS. 2A-2C are scanning electron microscope micrographs showing in 500×, the outermost $Al_2O_3$ layer of inserts according to the present invention, with various amounts of titanium oxide residues after the blasting process, in which in FIG. 2A A—$Ti_2O_3$ residues, and B—$Al_2O_3$.
Figure 2B:
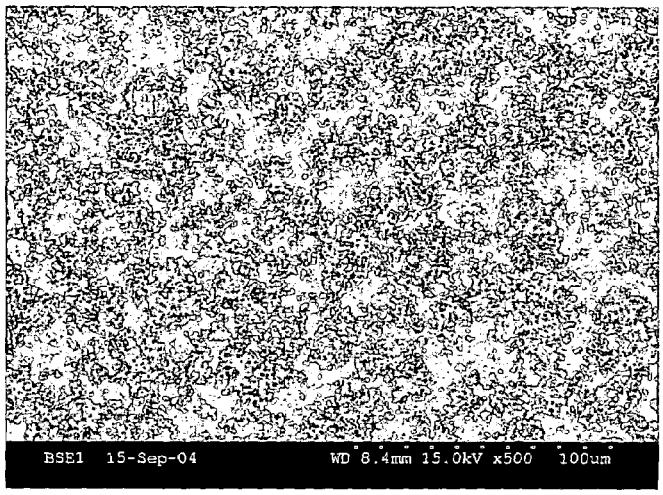
Figure 2C:
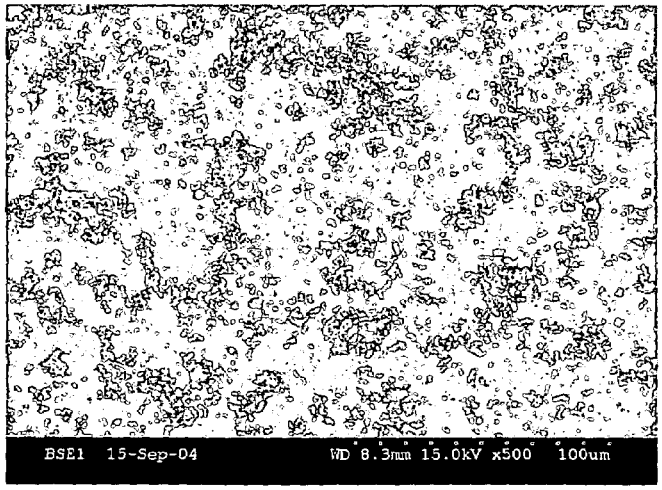
Figure 3:
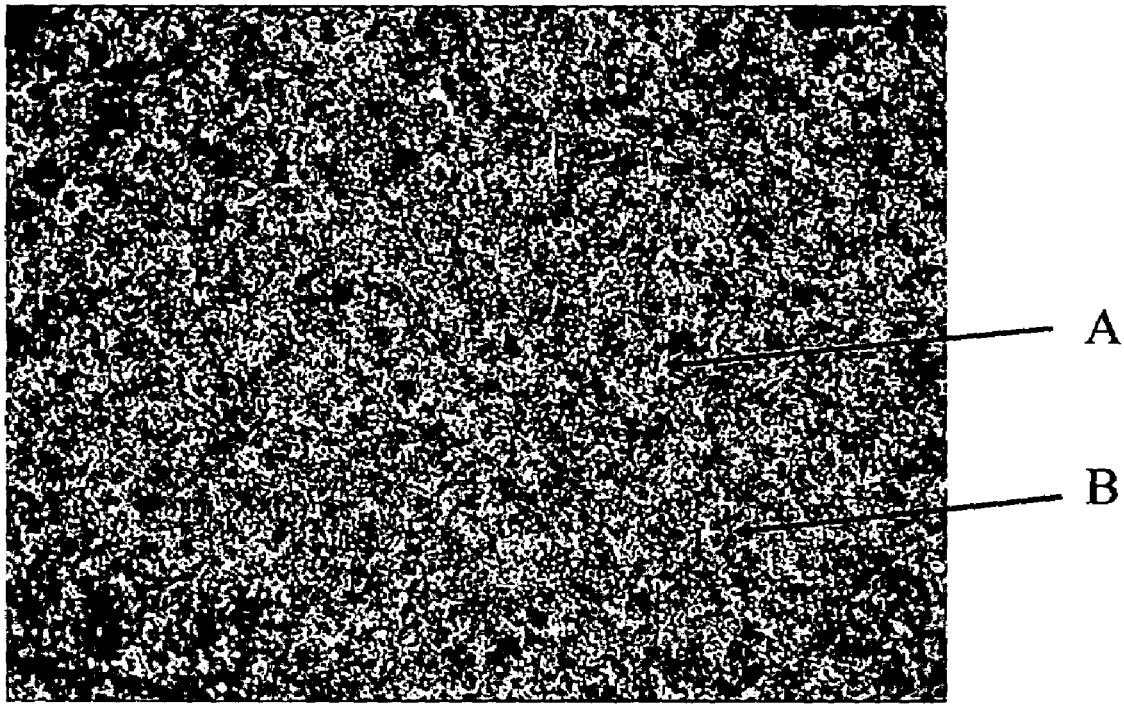
FIG. 3 is a light microscope micrograph showing in 200×, the outermost $Al_2O_3$ layer of an insert edge according to the prior art, with titanium nitride residues after the blasting process, in which A—TiN residues, and B—$Al_2O_3$.

| | | |
|---|---|---|
| Sample A, blasting at 1.8 bar (invention) | Some amount of TiN residues on the $Al_2O_3$-surface as observed by light microscope (FIG. 1A). Insert surface appear lightly discolored to the naked eye. | <75% of $Al_2O_3$-surface covered by residual $Ti_2O_3$ (FIG. 2A). |
| Sample A, blasting at 2.0 bar (invention) | <1% of $Al_2O_3$-surface covered by residual TiN (FIG. 1B). No discoloration of the insert surface. | <50% of $Al_2O_3$-surface covered by residual $Ti_2O_3$. (FIG. 2B) |
| Sample A, blasting at 2.2 bar, (invention) | No residues of TiN (FIG. 1C). No discoloration of the insert surface. | <30% of $Al_2O_3$-surface covered by residual $Ti_2O_3$. (FIG. 2C) |
| Sample B, blasting at 2.4 bar (prior art) | Large amount of TiN residues on the $Al_2O_3$-surface as observed by light microscope (FIG. 2). Insert surface appear discolored to the naked eye. | — |

Although the present invention has been described in connection with preferred embodiments thereof, it will be appreciated by those skilled in the art that additions, deletions, modifications, and substitutions not specifically described may be made without departing from the spirit and scope of the inventions as defined in the appended claims.

The invention claimed is:

1. A method for making a coated cutting tool insert having an upper face, an opposite face and at least one clearance face intersecting said upper and opposite faces to define cutting edges comprising depositing by CVD, onto a cemented carbide, titanium based or ceramic substrate a first layer system, having a total thickness of from about 2 to about 50 μm, comprising at least one layer selected from titanium carbide, titanium nitride, titanium carbonitride, titanium carboxide and aluminum oxide, and an outer, from about 1 to about 15 μm thick, aluminum oxide layer or $(Al_2O_3+ZrO_2)$*N multilayer, a penultimate outermost layer of $TiO_x$, where x ranges from about 1 to about 2 and an outermost, from about 0.3 to about 2 μm thick, $TiC_xN_yO_z$ layer, where x+y+z=1, x≧0, y≧0, and z≧0, followed by a post-treatment removing at least said outermost layer on the cutting edge and on the upper face, wherein said post-treatment also removes the $TiO_x$ layer on at least 50% of the surface area of the cutting edge and the upper face.

2. A method for making a coated cutting tool insert of claim 1 wherein the deposited $TiO_x$ layer thickness is from about 0.05 to about 3 μm.

3. A method for making a coated cutting tool insert of claim 2 wherein the deposited $TiO_x$ layer thickness is from about 0.1 to about 1 μm.

4. A method for making a coated cutting tool insert of claim 1 wherein in said penultimate outermost layer of $TiO_x$, x is from about 1.3 to about 1.9.

5. A method for making a coated cutting tool insert of claim 1 wherein said post-treatment is blasting or brushing.

6. A method for making a coated cutting tool insert of claim 1 wherein the outermost layer is a single layer or multilayer of TiN, TiC or $TiC_xN_y$, where x+y=1, x≧0 and y≧0.

7. A method for making a coated cuffing tool insert of claim 1 wherein the outermost layer is a single layer or multilayer of TiN, TiC or $TiC_xN_y$, where x+y=1, x≧0 and y≧0.

8. A method for making a coated cutting tool insert of claim 1 wherein the $TiO_x$ is $Ti_2O_3$.

* * * * *